US005255627A

United States Patent [19]

Williams

[11] Patent Number: 5,255,627

[45] Date of Patent: Oct. 26, 1993

[54] FLAG AND FLAGPOLE ATTACHMENT

[76] Inventor: Herbert T. Williams, 7148 S. Poplar La., Englewood, Colo. 80112-1635

[21] Appl. No.: 887,074

[22] Filed: May 22, 1992

[51] Int. Cl.[5] ..... G09F 17/00

[52] U.S. Cl. ..... 116/174; 248/418; 248/516

[58] Field of Search ..... 116/173, 174, 175; 248/418, 516, 534, 288.3

[56] References Cited

U.S. PATENT DOCUMENTS

| | | | |
|---|---|---|---|
| 463,165 | 11/1891 | Painter | 248/516 |
| 634,140 | 10/1899 | Hart | 116/174 |
| 663,761 | 12/1900 | Johnson | 116/173 |
| 807,857 | 12/1905 | Palmenberg | 248/288.3 X |
| 975,114 | 11/1910 | Blank | 116/174 |
| 1,253,380 | 1/1918 | Hoffman | 116/174 |
| 3,540,406 | 11/1970 | Dexter | 116/173 |
| 4,829,687 | 5/1989 | Rumpf | 248/516 X |

FOREIGN PATENT DOCUMENTS

| | | | |
|---|---|---|---|
| 2614126 | 10/1988 | France | 116/173 |
| 621884 | 2/1981 | Switzerland | 116/174 |
| 199926 | 7/1923 | United Kingdom | 248/516 |

*Primary Examiner*—William A. Cuchlinski, Jr.
*Assistant Examiner*—John L. Beres
*Attorney, Agent, or Firm*—Donald W. Margolis; Edwin H. Crabtree

[57] ABSTRACT

An attachment device for mounting on a flagpole and for releasable attachment to an edge portion of a flag to prevent the flag from entanglement with adjacent structures and also from wrapping around the flagpole. The attachment device includes a pole mounting bracket adapted for receipt on a portion of the flagpole. A control arm is pivotally mounted in a holder disposed in the pole mounting bracket and is capable of extending outwardly therefrom positioned along and parallel to an edge portion of a flag. A removable clip is used for attaching the edge portion of the flag to the control arm, thereby allowing the opposed edge of the flag to flow freely. The control arm is positioned with respect to the pole mounting bracket in a manner which allows it to pivot around the pole in a range of less than 360 degrees, thereby preventing the flag from wrapping around the pole or from becoming entangled in adjacent structure.

18 Claims, 2 Drawing Sheets

FLAG AND FLAGPOLE ATTACHMENT

PRIOR DOCUMENTS

Applicant filed Disclosure Receipt No. 277,364 on Mar. 25, 1991 on the subject invention.

BACKGROUND OF INVENTION (a) Field of the Invention

This invention relates to a device for preventing a flag from fouling, and more particularly, but not by way of limitation, to a device for mounting on a flagpole for attachment to a flag. The device is used to control the movement of flag so that the flag is prevented from wrapping around a flagpole and from being entangled in any structure or object which is adjacent to the flag and flagpole.

(b) Discussion of the Prior Art

Heretofore there have been a variety of different types of flag holders, flag attachments, and sign support structures as described in U.S. Pat. No. 975,114 to Blank; U.S. Pat. No. 1,680,703 to Sullivan; U.S. Pat. No. 2,858,793 to Palmer; U.S. Pat. No. 3,081,734 to Spahl; and U.S. Pat. No. 4,700,655 to Kirby. None of these patents disclose the unique structure and advantages of the subject flagpole attachment device.

In U.S. Pat. No. 982,645 to Suhr; U.S. Pat. No. 1,277,347 to Allen; U.S. Pat. No. 1,035,990 to Mink; U.S. Pat. No. 1,253,380 to Hoffman and Swiss Patent 621,884 to Brugger, various types of flagpole attachments are shown for engaging a portion of the flag and preventing the flag from wrapping around a flagpole. While these patents broadly disclose flagpole attachment devices to prevent fouling, none of the patents describe the specific structure and advantages of the subject invention for limiting the travel of a waving flag and preventing flag entanglement with an adjoining structure.

SUMMARY OF THE INVENTION

In view of the foregoing, it is an object of the present invention to provide a flagpole attachment device which prevents a flag, banner, sign and the like from wrapping around a supporting pole and also prevents the flag from becoming entangled in adjoining structure next to the pole.

Another object of the invention is to provide a flagpole attachment device that can be quickly and easily mounted on a standard flagpole and attached to a portion of a flag mounted on the pole, for example, secured to the bottom of the flag, thereby allowing the flag to flow freely in the wind and having a natural wave free appearance when viewed from a distance.

Still another object of the present invention is to provide a flagpole attachment device which can be folded parallel and adjacent to a portion of the flagpole for convenient storage when it is desired to either store the flag on the pole or after the flag from the pole.

Still another object of the present invention is to provide such a flagpole attachment device which is adapted for easy attachment to and removal from a flagpole and a flag.

A further object of the present invention is to provide a flagpole attachment device which is rugged in construction, streamlined in design, and which can be quickly installed and is removed, and which is made of a heavy duty plastic for a long service life.

The subject flagpole attachment device includes a hollow pole mounting bracket adapted for receipt around a portion of the flagpole and secured thereto. A control arm with a ball mounted at one end is pivotly mounted in a socket disposed in the pole mounting bracket. The control arm extends outwardly from the pole mounting bracket and is positioned along and parallel to a bottom portion of the flag. A removable flag clip is used for attaching the bottom portion of the flag to the control arm. By design, the control arm is allowed to pivot on the pole mounting bracket in a range of less than 360 degrees, thereby allowing the flag to wave freely on the pole. Because the control arm limits the flag movement to a pivotal travel of less than 360 degrees, the flag is prevented from wrapping around the pole or from becoming entangled in an adjacent structure such as a roof, rain gutter, porch light, fence, shrubs and the like.

These and other objects of the present invention will become apparent to those skilled in the art from the following detailed description, showing the contemplated novel construction, combination, and appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
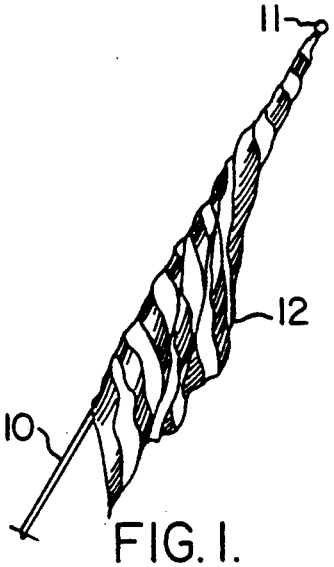
FIG. 1. (PRIOR ART)
FIG. 1 is a perspective view of a prior art flagpole showing an American flag wrapped around that flagpole.
Figure 2:
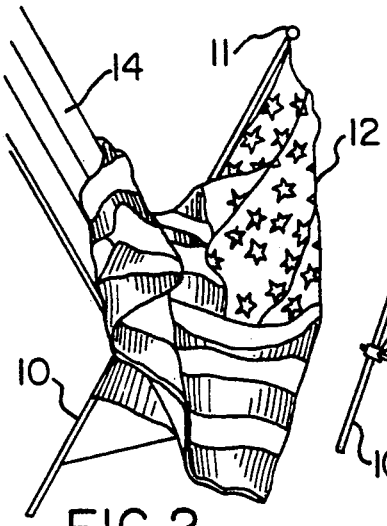
FIG. 2. (PRIOR ART)
FIG. 2 is a perspective view of a prior art flagpole showing an American flag entangled on a portion of a roof adjacent to an exterior wall used for mounting the flagpole thereon.

In FIG. 1 a flagpole 10 with emblem 11 is shown in a perspective view with an American flag 12 mounted thereon. The subject invention which will be described thoroughly herein is readily adaptable for use with banners, signs, markers, and different sizes and shapes of flags similiar to flag 12. In this drawing the flag 12 is shown wrapped around the flagpole 10. This is a common problem when displaying a flag and is due to strong or gusty winds which wind the flag on the pole. Also FIG. 2 illustrates another common problem of the flag 12 being entangled on a roof structure 14. Again, with winds that tend to whip the flag 12 in various directions it is not uncommon for the flag 12 to become tangled in adjoining structure such as rain gutters, roofs, fences, shrubs and the like.

Figure 3:
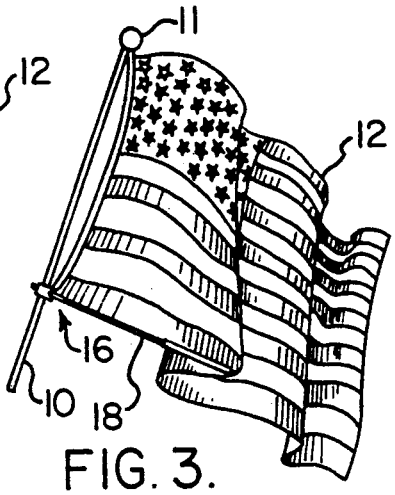
FIG. 3 is a perspective view of a flagpole with the subject invention mounted thereon and releasably attached to a bottom edge portion of the American flag.**

In FIG. 3 the subject flagpole attachment device is shown and designated by general reference character 16. The device 16 is shown secured to the pole 10 and to a bottom portion 18 of the flag 12. In this illustration, the flag 12 is unincumbered and waving free from the pole 10 and any adjacent structure. It should be mentioned that while the device 16 is adapted for mounting on standard ¾ inch diameter flagpoles, it can be easily adapted to different sizes and shapes of flagpoles. Also it should be mentioned that while the device 16 is attached to the bottom edge of the flag 12 so that the flag will flow freely in the wind, the device 16 could also be attached to the top edge of the flag or to an intermediate body location of the flag 12.

Figure 4:
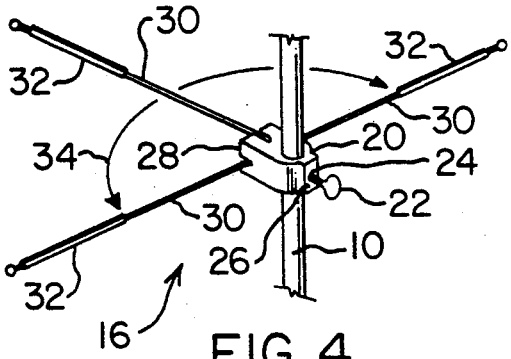
FIG. 4 is an upper rear perspective view of the flagpole attachment mounting bracket attached to a flagpole and illustrating the angle of pivot of a control arm which is pivotly attached to the mounting bracket.

FIG. 4 illustrates a perspective view of the device 16 secured to the pole 10 without the flag 12. The device 16 includes a hollow pole mounting bracket 20 having a thumb screw 22 received in a threaded aperture 24 in a first side 26 of the bracket 20. When the screw 22 is tightened in the aperture 24, the screw 22 engages a portion of the pole 10 for securing the bracket 20 thereto. Extending outwardly from a second side 28 of the bracket 20 is a control arm 30 having a removable flag clip 32 received thereon. In this drawing an arrow 34 shows how the control arm 30 pivots on the bracket 20 in a range up to 180 degrees. While the control arm 30 by design limits the travel of the waving flag 12, the amount of travel can vary for example from 90 degrees or less depending on the closeness of an adjacent bracket structure. Similarly, the limited travel can be increased to greater than 180 degrees, but less than 360 degrees, as long as the flag is not allowed to wrap around the flagpole 10 or engage a structure nearby. Also it should be added that through trial and error, a limited travel of the control arm 30 in a range of up to about 165 degrees has been found to be ideal for most uses.

Figure 5:
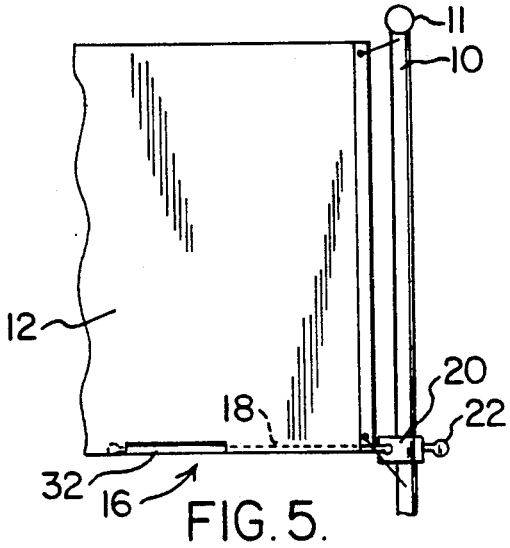
FIG. 5 is a front view of the mounting bracket with the control arm extending outwardly at a right angle from the flagpole, and with a flag clip attached to the control arm and the bottom edge portion of the flag.
Figure 6:
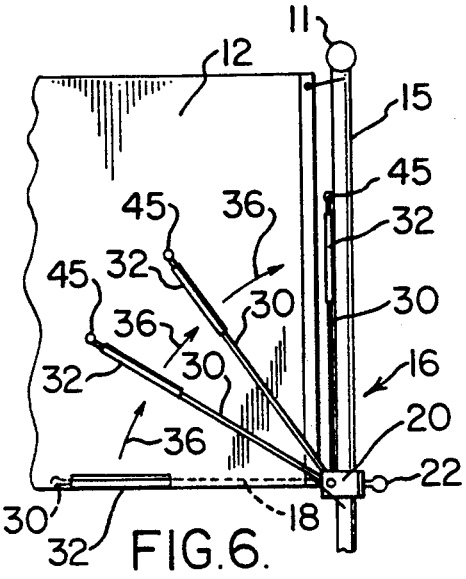
FIG. 6 is a front view of the mounting bracket, similar to FIG. 5, with the control arm extending outwardly at a right angle from the flagpole, and also showing the arm moved to a raised position parallel to the side of a portion of the flagpole, and also in two intermediate positions.

In FIG. 5 a front view of the device 16 is shown with the removable flag clip 32 received around the bottom portion 18 of the flag 12 and secured to the control arm 30. The control arm 30 attached to the bracket 20 extends along the bottom portion 18 of the flag 12 outward at a right angle from the pole 10. When it is desired to store the flag 12 as shown in FIG. 6, the flag clip 32 is removed from the control arm 30 and the bottom portion 18 of the flag 12. The control arm 30 is than folded upwardly as shown by arrows 36 until it is positioned adjacent to and parallel to the length of the flagpole 10. The flag clip 32 can be placed again on the control arm 30 for safe storage until the flagpole mounting bracket 20 is again required when flying the flag 12.

Figure 7A:
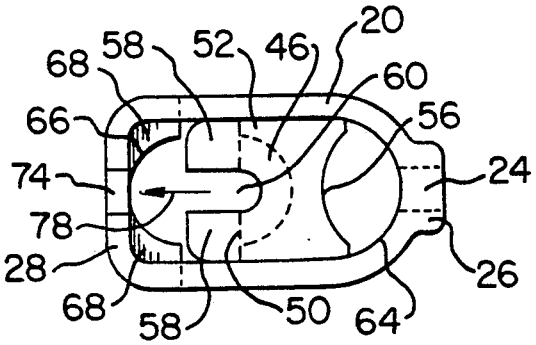
FIG. 7A is a top view, partially in phantom, of the removable socket housing of FIG. 17, disposed inside the hollow pole mounting bracket.
Figure 7:
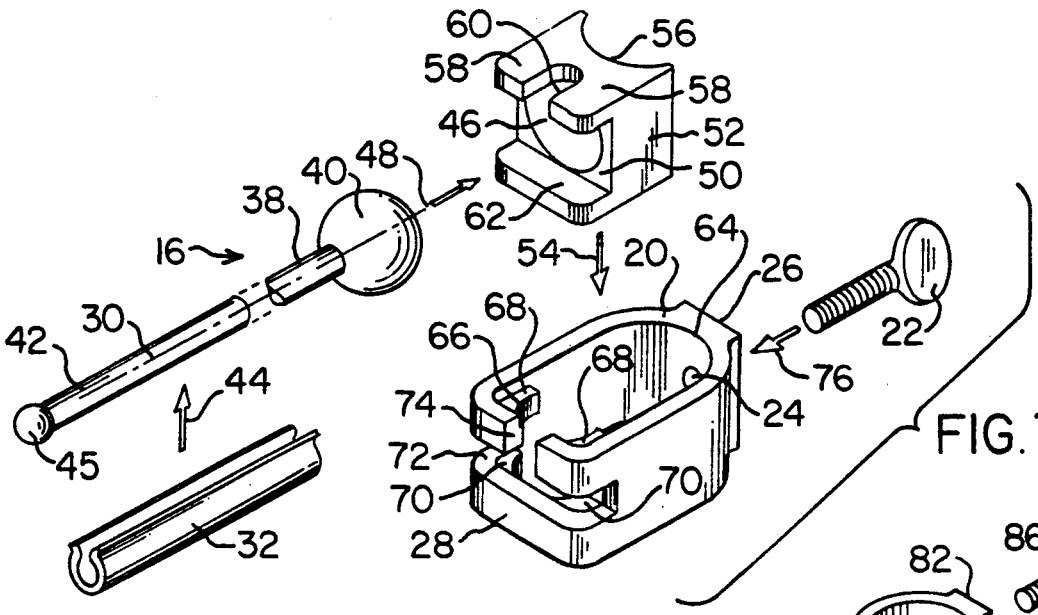
FIG. 7 is an enlarged, exploded perspective view of the flag clip, with the control arm shown broken away and including a terminal ball, removable socket housing and hollow pole mounting bracket.

In FIG. 7 a detailed exploded perspective view of the control arm 30, shown partially broken away, and the hollow pole mounting bracket 20 is shown. The control arm 30 includes a first end 38 having a large ball 40 integrally formed thereon. A second end 42 of the control arm 30 is used for receiving the removable flag clip 32, as indicated by arrow 44, thereon in a press fit with part of the bottom portion 18 of the flag 12 received therebetween. A small ball 45 is integrally formed in the second end 42 of the control arm 30 to prevent the flag clip 32 from sliding off of the second end 42 when the attachment device 16 is in operation. The large ball 40 is received in a socket 46, as indicated by arrow 48, in a first side 50 of a removable socket housing 52. The socket housing 52 is part of the hollow pole mounting bracket 20 and is received therein as indicated by arrow 54. A second side 56 of housing 52 is concave in shape for receipt around a portion of the circumference of the flagpole 10. The housing 52 also includes an upper flange 58 with a groove 60 therein and a lower flange 62. The groove 60 in the upper flange 58 is used to receive a portion of the control arm 30 when the arm is rotated upwardly on the bracket 20 as shown in FIG. 6.

Referring now to FIGS. 7 and 7A, the hollow pole mounting bracket 20, the bracket 20 is shown to include a first interior concave side 64 adjacent the first side 26 for engaging a portion of the circumference of the flagpole 10 when it is received therein. A second interior concave side 66 adjacent the second side 28 includes an upper shelf 68 and a lower shelf 70 for receiving the upper flange 58 and lower flange 62 thereagainst, when the housing 52 is secured inside the mounting bracket 20. A horizontal groove 72 is cut in the second side 28 of the bracket 20 for allowing the pivot of the control arm 30. A vertical groove 74 in the second side 28 is centered next to horizontal groove 72 for receiving a portion of the control arm 30 when it is folded upwardly as shown in FIG. 6. Also shown in detail in FIG. 7 is the thumb screw 22 positioned for receipt in the threaded aperture 24 as indicated by arrow 76.

In FIG. 7A, a top view of the mounting bracket 20 is shown with the removable socket housing 52 received therein. When the socket housing 52 is moved to the left, as indicated by arrow 78, the groove 60 in the housing 52 is indexed with the vertical groove 74 of the bracket 20 and the upper flanges 58 are received on top of the upper shelf 68. At the same time the lower flange 62 engages the bottom of the lower shelf 70. The ball 40 is not shown received in the socket 46 in FIG. 7A. Also the control arm 30 is not shown extending through the horizontal groove 72 of the bracket 20, as shown in FIG. 4. Further when the housing 52 is properly seated in the bracket 20, the concave second side 56 of the housing 52 and the first interior concave side 64 are properly positioned for receiving the flagpole 10 therebetween.

Figure 9:
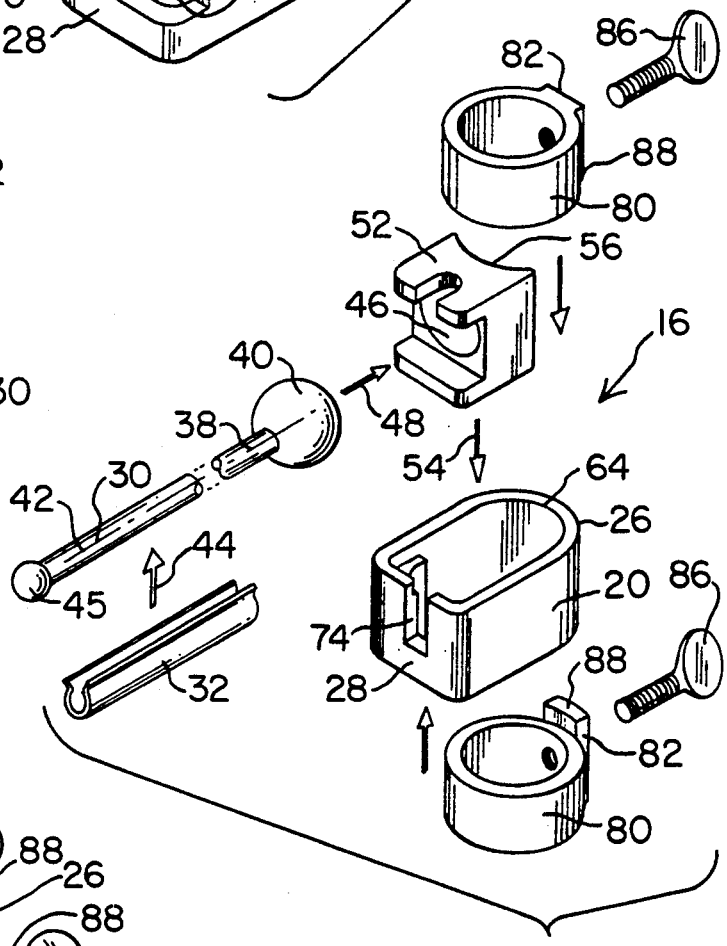
FIG. 9 is an exploded perspective view of the alternate embodiment of FIG. 8 in which the flagpole attachment device includes a hollow pole mounting bracket which is adapted for limited pivotal travel on the flagpole, and using a pair of flagpole sleeves secured to the flagpole to limit the amount of pivot of the control arm.

In FIG. B, and in an exploded perspective view in FIG. 9, flagpole attachment device 16 is shown in an alternate embodiment. The control arm 30 is shown with ball 40 in a position for receipt in the socket 46 of the socket housing 52, as indicated by arrow 48. Also the flag clip 32 is shown in position for receipt on the control arm 30 as indicated by arrow 44. Further the housing 52 is in a position for receipt in the mounting bracket 20 as indicated by arrow 54. The bracket 20 also includes the first side 26 and the second side 28, but does not include the threaded aperture 24 for receiving the thumb screw 22, as shown in FIGS. 4 and 7. The bracket 20 includes the vertical groove 74 for raising and lower the control arm 30 as shown in FIG. 6, but the bracket 20 does not include the horizontal groove 72 for allowing the control arm 30 to pivot back and forth in a limited range. The bracket 20 has a first interior concave side 64 which is opposite the second concave side 56 of the housing 52, when the housing 52 is received in a slip fit inside the bracket 20. The two opposite sides 56 and 64 engage the sides of a portion of the flagpole 10 as shown in FIG. 9. Without the thumb screw 22 to tighten the bracket 20 on the flagpole 10, the bracket 20 with housing 52 and control arm 30 are free to rotate on the pole 10.

Figure 8:
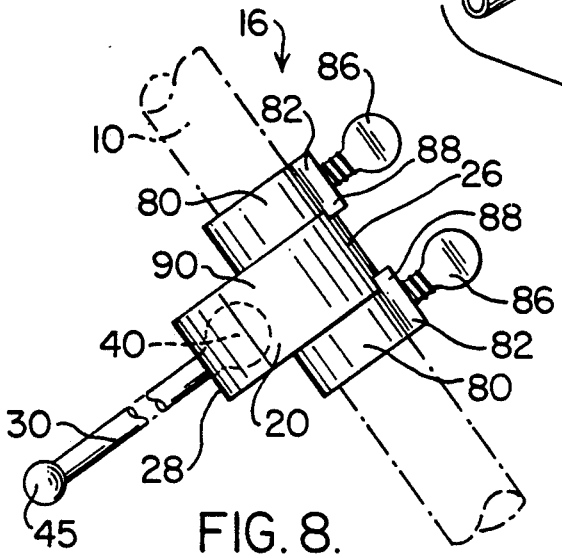
FIG. 8 is a side elevational view of an alternate embodiment of the flagpole attachment device.

The device 16, as shown in FIGS. 8 and 9, includes upper and lower flagpole sleeves 80 having a stop 82 integrally formed therein and at the rear of the sleeves 80. A threaded aperture 84 is disposed through the stops 82 for receiving thumb screws 86 of tightening the sleeves 80 on the flagpole 10. The sleeves 80 rest on the top and the bottom of the bracket 20 and socket housing 52 with a lip portion 88 extending over a portion of the first side 26 of the bracket 20.

Referring now to FIG. 8, the device 16 is shown in a side view installed on the flagpole 10. The two sleeves 80 are secured to the pole 10 with the thumb screws 86 with the bracket 20 positioned between the sleeves 80. The ball 40, shown in dotted lines, is received in the socket housing 52, which is engaged in a press fit inside the bracket 20. When the bracket 20 rotates on the pole 10, an outwardly extending portion 90 of the bracket 20 engages the lip portion 88 of the stops 82, thereby preventing the bracket 20 from completely rotating 360 degrees on the flagpole 10. Through the use of the lip portion 88 of the stops 82 the amount of travel of the bracket 20 is controlled, so that for example the control arm 30 will allow the flag 12 to pivot on the pole 10 in a range of less than 360 degrees.

Figure 10:
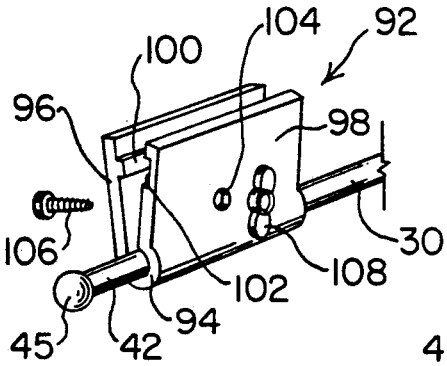
FIG. 10 is a perspective view of an alternate embodiment of the removable flag clip shown in FIGS. 4–7.

In FIG. 10, an alternate type of a flag clip is shown having a general reference numeral 92. The flag clip 92 is generally "U" shaped, having an open circular bottom portion 94 for receiving a portion of the control arm 30 therein with a first upwardly extending arm 96 and a second upwardly extending arm 98. The first arm 96 includes an outwardly extending rib 100 which is received in an elongated groove 102 in the second arm 98, when the two arms 96 and 98 are compressed together. Both of the arms 96 and 98 have an aperture 104 therethrough for receiving a screw 106. The screw 106 is secured to a wing nut 108 for holding the arms 96 and 98 against each other. When the arms 96 and 98 are spread apart the bottom portion 18 of the flag 12 is placed over the rib 100 and compressed inside the groove 102 and held therein. The screw 106 and wing nut 108 are than tightened together holding the arms 96 and 98 against each other. The flag 12 is not shown in FIG. 10. When it is desired to remove the flag 12 from the flagpole 10 and fold the flagpole attachment device 16 next to the pole 10, the second flag clip 92 can quickly be removed from the bottom portion 18 of the flag 12 by removing the wing nut 108 from the screw 106 and again spreading the arms 96 and 98 apart. The bottom portion 18 of the flag 12 is than removed from the sides of the extended rib 100 of the arm 96.

In the installation of the subject invention, the emblem 11, if any, is removed from the top of the flagpole 10. The hollow pole mounting bracket 20 with control arm 30 attached thereto is than slipped over the top of the pole 10 and moved down the pole 10 until the control arm 30 is parallel and approximately ½ inch above the bottom portion 18 of the flag 12. The thumb screw 22 is than tightened on the pole 10. Using the removable flag clip 32 or the second flag clip 92 shown in FIG. 10, the flag 10 is now attached securely to the control arm 30. The control arm 30 being perpendicular to the flagpole 10 now moves freely with the wind against the flag 10. The flag 10 will wave naturally and beautifully, and because the movement or travel of the control arm 30 on the bracket 20 is limited by the nature of the length of the horizontal groove 72 in the second side 28 of the bracket 20, the flag 10 is prevented from becoming entangled and wrapped around the pole 10. Also when the embodiment of the control bracket 20 is used as shown in FIGS. 8–9, the stops 82 control the movement of the bracket 20 pivoting on the pole 10. This control of the bracket movement prevents the flag from wrapping around the pole 10 or becoming entangled in an adjacent structure.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A flagpole attachment device for mounting on a flagpole and for releasable attachment to a portion of a flag, the flagpole attachment device preventing the flag from entanglement with an adjacent structure and preventing the flag from wrapping around the flagpole, the attachment device comprising:

a mounting bracket adapted for releasable attachment to a portion of a flagpole;

a removable socket housing, including a socket, received in said mounting bracket in a press fit;

a control arm including a bal at one end thereof, said ball pivotally mounted within said socket in said removable socket housing on said mounting bracket, so that when said control arm pivots on said mounting bracket said ball pivots in said socket said control arm extending outwardly from sad mounting bracket and adapted for disposition adjacent to the side of a flag;

flag attachment means for releasable attachment of a flag to said control arm; and pivot limiting means on said mounting bracket for controlling the amount of pivot of said control arm on said mounting bracket in a range of less than about 360 degrees.

2. The attachment device as described in claim 1 wherein said pivot limiting means on said mounting bracket is a first groove therein for receiving a portion of said control arm as said control arm pivots on said mounting bracket.

3. The attachment device as described in claim 1 wherein said mounting bracket includes a second groove therein for receiving a portion of said control arm when said control arm is folded upwardly on said mounting bracket when storing the attachment device.

4. The attachment device as described in claim 1 wherein said mounting bracket is hollow for receiving the flagpole therethrough, said mounting bracket having a thumb screw received in a side thereof for tightening the mounting bracket on the flagpole.

5. The attachment device as described in claim 1 wherein said flag attachment means is a flag clip for securing the flag to said control arm.

6. A flagpole attachment device for mounting on a flagpole and for releasable attachment to a portion of a flag, the flagpole attachment device preventing the flag from entanglement with an adjacent structure and preventing the flag from wrapping around the flagpole, the attachment device comprising:

a hollow mounting bracket adapted for receipt around a portion of the flagpole and for releasable attachment to the flagpole;

a removable socket housing, including a socket, in one side of said socket housing, said socket housing received in said mounting bracket in a press fit;

a control arm having a ball at one end pivotally mounted in said socket in said mounting bracket, said control arm extending outwardly from said mounting bracket and disposed adjacent to the side of the flag;

flag attachment means for releasable attachment of the flag to said control arm; and pivot limiting means on said mounting bracket for controlling the amount of pivot of said control arm on said mounting bracket in a range of less than about 360 degrees.

7. The attachment device as described in claim 6 wherein said pivot limiting means on said mounting bracket is a horizontal groove therein for receiving a portion of said control arm as said control arm pivots on said mounting bracket.

8. The attachment device as described in claim 7 wherein a length of said horizontal groove around one side of said mounting bracket limits the travel of said control arm in a range of less than about 180 degrees.

9. The attachment device as described in claim 6 wherein said socket housing having a concave side opposite said socket side, said concave side being shaped to be received against a portion of the flagpole when the pole is received in said hollow mounting bracket.

10. The attachment device as described in claim 6 wherein said mounting bracket includes a vertical groove therein for receiving a portion of said control arm when said control arm is folded upwardly on said mounting bracket when storing the attachment device.

11. A flagpole attachment device for mounting on a flagpole and for releasable attachment to a portion of a flag, the flagpole attachment device preventing the flag from entanglement with an adjacent structure and preventing the flag from wrapping around the flagpole, the attachment device comprising:

a mounting bracket pivotly mounted on the flagpole;

a control arm mounted on said mounting bracket, said control arm extending outwardly from said mounting bracket and disposed adjacent to the side of the flag;

flag attachment means for releasable attachment of the flag to said control arm; and pivot limiting means mounted on the flagpole and disposed adjacent said mounting bracket for controlling the amount of pivot of said mounting bracket in a range of less than about 360 degrees.

12. The attachment device as described in claim 11 wherein said pivot limiting means is a flagpole sleeve having a stop thereon for engaging a portion of said mounting bracket when said mounting bracket pivots on the flagpole, said flagpole sleeve having a thumb screw received through a side thereof for securing said flagpole sleeve on the flagpole.

13. The attachment device as described in claim 11 wherein said pivot limiting means is a pair of flagpole sleeves having stops thereon and disposed on opposite sides of said mounting bracket for engaging a portion of said mounting bracket when said mounting bracket pivots on the flagpole, said flagpole sleeves having a thumb screw received through a side thereof for securing said flagpole sleeves on the flagpole.

14. The attachment device as described in claim 11 wherein said control arm includes a ball at one end thereof, said ball received in a socket disposed in said mounting bracket.

15. The attachment device as described in claim 14 wherein said socket is disposed in a removable socket housing received in said mounting bracket in a press fit.

16. The attachment device as described in claim 14 wherein said mounting bracket includes a groove therein for receiving a portion of said control arm when said control arm is folded upwardly on said mounting bracket and adjacent the flagpole when storing the attachment device.

17. The attachment device as described in claim 11 wherein said mounting bracket is hollow for receiving the flagpole therethrough.

18. The attachment device as described in claim 11 wherein said flag attachment means is a flag clip for securing the flag to said control arm.

* * * * *